US012571209B2

(12) United States Patent
Platt et al.

(10) Patent No.: US 12,571,209 B2
(45) Date of Patent: Mar. 10, 2026

(54) WALL PANEL

(71) Applicant: EEKOWALL LIMITED, Barnet (GB)

(72) Inventors: Derek Platt, London (GB); Michael Reilly, London (GB)

(73) Assignee: EEKOWALL LIMITED, Barnet (GB)

( * ) Notice: Subject to any disclaimer, the term of this patent is extended or adjusted under 35 U.S.C. 154(b) by 249 days.

(21) Appl. No.: 18/394,254

(22) Filed: Dec. 22, 2023

(65) Prior Publication Data

US 2024/0125118 A1 Apr. 18, 2024

Related U.S. Application Data

(63) Continuation of application No. PCT/IB2022/055959, filed on Jun. 27, 2022.

(30) Foreign Application Priority Data

Jun. 25, 2021 (GB) ..... 2109234

(51) Int. Cl.
*E04B 2/74* (2006.01)

(52) U.S. Cl.
CPC .... *E04B 2/7448* (2013.01); *E04B 2002/7479* (2013.01); *E04B 2002/7488* (2013.01)

(58) Field of Classification Search
CPC ..... E04B 2/7448; E04B 2002/7479; E04B 2002/7488; E04B 2002/7485; E04B 2/7411; E04B 1/6125
See application file for complete search history.

(56) References Cited

U.S. PATENT DOCUMENTS

| | | | | |
|---|---|---|---|---|
| 5,444,955 | A | 8/1995 | Ou | |
| 6,158,178 | A | 12/2000 | Jeffers et al. | |
| 6,434,890 | B1 | 8/2002 | Konnerth | |
| 7,520,100 | B1 | 4/2009 | Herrman et al. | |
| 9,157,232 | B2 * | 10/2015 | Stahl, Jr. | E04B 2/7411 |
| 9,719,251 | B2 * | 8/2017 | Gosling | E04B 1/34326 |
| 12,385,250 | B2 * | 8/2025 | Al-Haboobi | E04C 2/386 |
| 2014/0360115 | A1 | 12/2014 | Stahl, Jr. | |

(Continued)

FOREIGN PATENT DOCUMENTS

| | | | |
|---|---|---|---|
| CH | 610973 | A5 | 5/1979 |
| CN | 112376747 | A | 2/2021 |

(Continued)

OTHER PUBLICATIONS

Search Report and Written Opinion for PCT/IB2022/055959 (8 pages). (Year: 2022).*

(Continued)

*Primary Examiner* — Rodney Mintz
(74) *Attorney, Agent, or Firm* — Grossman, Tucker, Perreault & Pfleger, PLLC; Paul J. Kroon, Jr.

(57) ABSTRACT

A prefabricated wall panel for forming internal walls in a building is described. In an embodiment the panel comprises a rear board; a front board forming an internal wall for a room, said front board spaced away from said rear board to form a cavity; and a wireway disposed within the cavity, wherein the wireway comprises one or more channels that run substantially from a base of the wall panel to a top of the wall panel to allow services to pass through the panel, and wherein the wireway constrains cabling of the services within a channel.

15 Claims, 6 Drawing Sheets

(56) References Cited

U.S. PATENT DOCUMENTS

| | | | | |
|---|---|---|---|---|
| 2015/0143763 | A1* | 5/2015 | Gosling | E04B 2/7448 52/745.1 |
| 2023/0383535 | A1* | 11/2023 | Griechen | C12Y 403/01023 |
| 2024/0125117 | A1* | 4/2024 | Platt | E04B 2/7448 |
| 2024/0125119 | A1* | 4/2024 | Platt | E04B 2/7448 |
| 2024/0141640 | A1* | 5/2024 | Platt | E04B 2/7448 |
| 2024/0318428 | A1* | 9/2024 | Al-Haboobi | E04C 3/065 |

FOREIGN PATENT DOCUMENTS

| | | | |
|---|---|---|---|
| CN | 216446249 | U | 5/2022 |
| KR | 101143581 | B1 | 7/2011 |
| WO | 9815697 | A1 | 4/1998 |
| WO | 2012024742 | A1 | 3/2012 |

OTHER PUBLICATIONS

Amendment filed by Applicant in counterpart European Application No. 22776981.7 (9 pages). (Year: 2024).*

* cited by examiner

WALL PANEL

CROSS REFERENCE TO RELATED APPLICATIONS

The present application is a continuation of PCT/IB2022/055959, filed Jun. 27, 2022, which claims the benefit of GB 2109234.1, filed Jun. 25, 2021, both of which are fully incorporated herein by reference.

FIELD OF THE INVENTION

The invention relates to improvements in wall panels, in particular to prefabricated internal wall panels having channels for electrical wiring.

BACKGROUND

Modern methods of commercial construction are typically focused on prefabricated, modular systems that are then fixed together on site. Whilst some sectors of the construction industry have advanced in this area, internal partitions are significantly behind.

Such panels can be installed much quicker on site with less labour. The fixing methods do not require skilled labour and panels will be manufactured offsite in factory conditions where quality can be managed easily. This results in lower workforce presence on sites, with associated lower welfare and safety management risks and concerns as well as improving build programmes.

Whilst current prefabricated wall panels allow internal walls to be assembled more easily, they still typically require tradespeople, such as electricians, to install required electrical fixtures and fittings, each having their own regulatory requirements. For example, in modern commercial buildings and residential blocks main electrical services typically run within ceiling voids and thus electricians need to route power from this level to electrical sockets that are typically nearer floor and skirting level.

Typically this is achieved by routing a cable from the backbox position up to ceiling level by feeding an electrical cable through a hole made near ceiling level down to the backbox. However, electrical cables are typically fairly stiff and often snag within the cavity of the internal wall, making this process time consuming. Additionally, existing prefabricated panels require elements of the panel to be chased out when in position creating waste, mess and dust on site.

One prior example of a wall structure is shown in U.S. Pat. No. 5,444,955. This document shows a generic frame to which different boards are affixed. The frame and boards are wooden or foam and are sandwiched together. Services are provided by conduits or pipes that run horizontally along the length of the wall to feed wiring to switches or sockets. However, given the need to align adjacent panels and to feed wiring through multiple panels the issues of cable alignment and snagging are worse rather than improved. Also, whilst this system provides horizontal versatility in where a socket is placed, the socket must be installed at a height equal to the pre-installed pipe height.

A further example is shown in WO 2012/0247 42. This uses an external frame structure into which panels are engaged to form a wall structure. One example shows a central ducting that engages with internal connection boxes for connection of electrical power to switches or the like. The ducting is open at the top of the panel for feeding wiring. However, the space and the tolerances needed for feeding the wiring in this manner from a top channel creates a high amount of wasted space, and the cable angling required makes installation of wiring difficult. The ducting is also narrow, centralised, and gives little flexibility for placement of electrical switches or the like in multiple locations rather than within the predetermined ducting position.

Whilst there are some examples that use conduits fed into the cavity through chased out holes, these are a post installation solution to preventing snagging of the cable, and furthermore tend to be fairly small (not much bigger than the cabling used) and can therefore be difficult to align or to find if they were pre-installed.

It is an object of the present invention to at least ameliorate the above defined issues with the existing prior art.

SUMMARY OF THE INVENTION

In accordance with a first aspect of the present invention there is provided a prefabricated wall panel for forming internal walls in a building, said panel comprising: a rear board; a front board forming an internal face for a room, said front board spaced away from said rear board to form a cavity; and a wireway disposed within the cavity, wherein the wireway comprises one or more channels that run substantially from a base of the front board to a top of the front board to allow services to pass through the panel, and wherein the wireway constrains cabling of the services within a channel.

The wireway describes a defined passage or channel through which service cabling can be fed through the cavity within the wall panel. The use of a wireway prevents the cabling from being lost within the wall panel and makes feeding cabling through the wall panel easier. In particular, the channels of the wireway ensure that cabling is constrained within a defined width of the panel. The wireway can be accessed by either chasing out the desired portions of the front board to access a channel of the wireway behind, or by using defined openings. Given the positions of the channels are known prior to chasing out, a service technician can locate the wireway position such that cabling is installed within a channel.

In embodiments more than one channel may be provided, each channel may be spaced along a width of the front board to provide multiple positions for the service technician to install the service and to feed the required cabling. This gives versatility to the service technician and can also allow for multiple services to be installed side by side in separate channels, which may be adjacent to each other, without risk of the cabling from service interfering or entangling with another service cabling.

The services are typically power, with electrical cabling fed from a high level to a backbox installed at a lower point in the panel, or data that can be installed in a similar manner.

By prefabricating the wall panels, the panels can be manufactured off-site, with the wireway allowing a services technician to install services cabling efficiently and easily later. Additionally, said technicians can be more confident that installation of services will not interfere with existing services within the wall, allowing, for example, networking servicing cabling to be installed away from electrical cabling due to the use of multiple channels within the wireway.

Typically, in an embodiment the panel may further comprises: two side studs, each side stud connected to the front and rear boards on opposing sides of the cavity; and one or more support rails connected across said side studs and between the rear board and the wireway for supporting the wireway.

The side studs may comprise a framework, such as a metal frame, that attaches to the front and back boards. This framework acts to provide separation between the boards to provide the cavity therebetween. The framework can also be used to secure the wireway either directly or through the use of support structures such as support rails.

The use of support rails provide structural support for the wireway and also provide structures to which service backboxes can be affixed. The side studs may comprise a plurality of tabs, said tabs extendable away from the side studs into the void and providing a fixing point for the support rails. Typically the side studs comprise a metal profile, and the tabs are punched into the profile. This allows multiple tabs to be provided, which in turn allows the support rails to be supported at varying heights relative to the front board of the wall panel. In embodiments where the tabs are punched into the metal profile, the tabs may be configured to fold away from the profile to provide the fixing point.

In some embodiments the panel may further comprise a backbox secured to one of the support rails in a cutaway through the front board and the wireway. Said backboxes provide outlets for services and are connected to said service supply. Typically the backbox is secured in a cutaway that is located within a (single) channel of the wireway such that cabling can be fed within said channel during connection of the services.

In an embodiment the wireway may be made of cardboard. This allows for low cost and light weight, whilst also providing enough strength to prevent the wires from punching through said wireway and into either neighbouring channels or into the void. Furthermore, the use of cardboard can allow for a smooth surface to deflect the cabling as it is passed through the channel.

Generally the wireway runs part of the length of the wall panel rather than for the entire length of the panel. This both reduces material use and weight, as well as cost, and can provide a floor to the wireway such that cabling cannot be advanced too far through the channels.

The front board may further comprise a service access panel coupled to or provided in a top portion of the front board, said service access panel providing an opening through which cabling of services can be fed through the panel.

The panel may further comprise pattress plates disposed between the wireway and the front board, said pattress plates for supporting structural wall mounted fixtures and fittings.

The front board is typically a gypsum based board, such as a plasterboard or the like. The rear board may also be a gypsum based board such that the wall panel can be used as an internal wall in a room, with both the front board and the rear board forming an internal face for a room. It can be appreciated that whilst shown as aligned back to back the front and back boards may not necessarily be aligned parallel to each other. For example, the back board may comprise two perpendicular boards aligned perpendicular to each other, with the front board forming the hypotenuse. This arrangement may be useful in room corners or when arranging the panel in front of existing wall structures.

In some embodiments the back board is not a gypsum based board, but is instead a lightweight material, such as cardboard, forming a liner. This can be useful if the back board is not intended for forming an internal face for a room. One example where this occurs is in a party wall structure. It can be appreciated that two panels may be placed adjacent to each other with the front boards facing outwardly to form a sandwich structure. This sandwich structure may be used for party walls that separate rooms between different houses, apartments or the like. When used for party walls, it can be appreciated that the back board need not be gypsum and so is typically cardboard or the like as described above. Wireways may be provided on both panels that make up the party wall such that each service runs through a single panel to supply different dwellings. In this manner, the central cavity between panels that form the party wall can be kept clear of cabling making maintenance for a single dwelling easier and eliminating the risk of service cabling for adjacent dwellings becoming entangled.

The pattress plates typically span substantially the width of the panel to allow for securing of fixtures and fittings across the panel.

The wireway may be substantially the same width and height as the cavity. This allows wiring to be fed into the wireway at any point within the cavity. It can be appreciated that the use of passages and pattress plates allow for precise locating of electrical sockets at broadly any point of the panel.

The wireway may comprise perforations or holes in a top of the wireway through which cabling can be fed. This may allow the cabling to be fed into the front of the panel through the perforations or holes. Additionally or alternatively the wireway may further comprise an additional set of perforations or holes in a bottom of the wireway.

The perforations or holes provide predefined points at which an installer can drill into the wireway for feeding electrical services into the wireway.

In some embodiments the panel may be invertible. Where perforations or holes are provided at the top and bottom, inverting of the panel allows for the benefits of the perforations to be maintained in either panel orientation.

According to a second aspect of the present invention there is provided a method for installing services in a prefabricated wall panel, said method comprising the steps of: forming a wall comprising one or more wall panels according to any preceding wall panel claim; creating an cutaway through said front board and said wireway, said cutaway located solely within one channel; installing a backbox within said cutaway; feeding services cabling through the one channel to the backbox through the or an opening in a top portion of the front board.

Embodiments of the aspects may comprise any element of any embodiment of the other aspects of the invention.

BRIEF DESCRIPTION OF THE FIGURES

The invention is described in further detail below by way of example and with reference to the accompanying drawings, in which.

Figure 1:
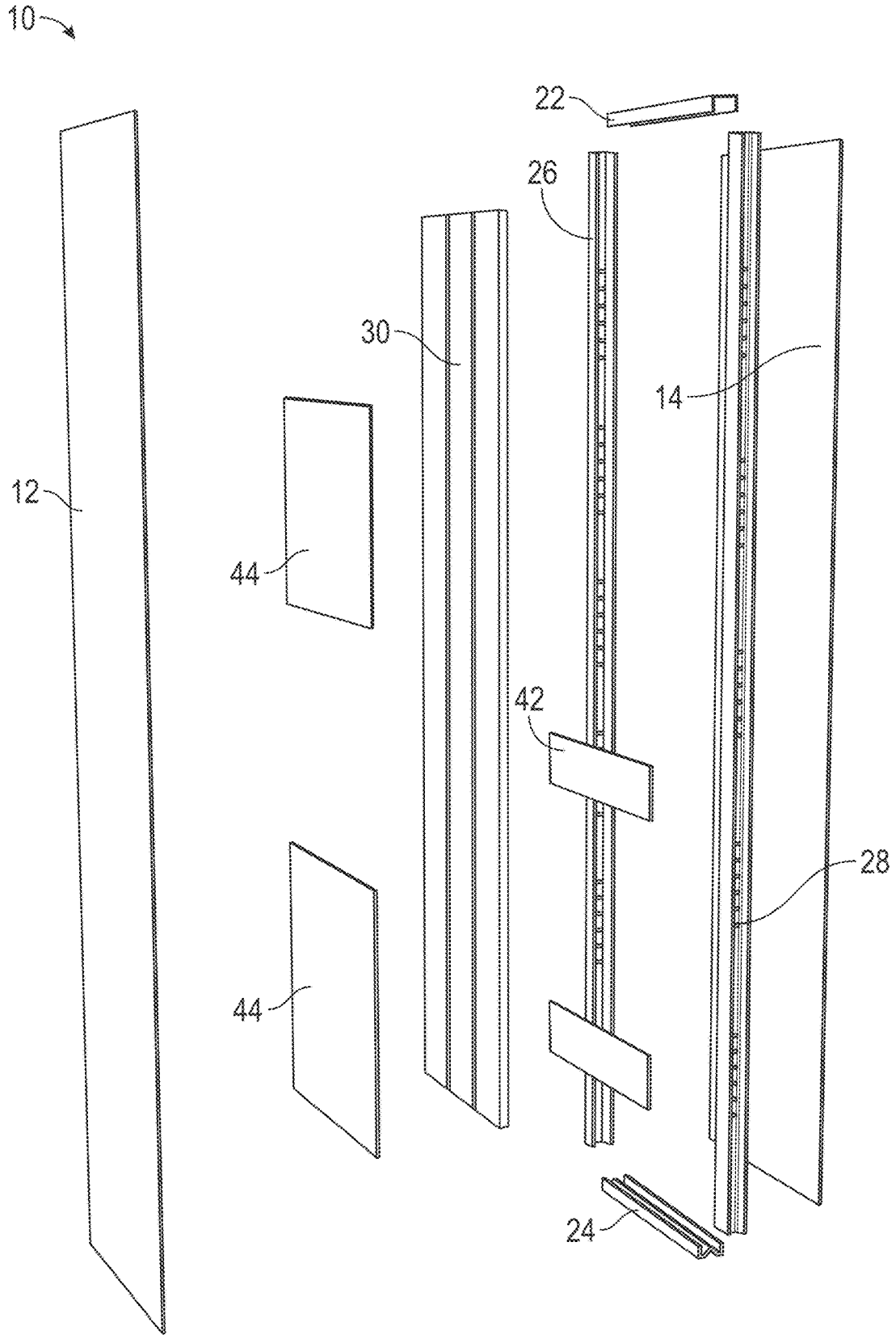
FIG. 1 shows an exploded view of a prefabricated internal wall panel according to an embodiment of the present invention.

It should be noted that the Figures are diagrammatic and not drawn to scale. Relative dimensions and proportions of parts of the Figures have been shown exaggerated or reduced in size, for the sake of clarity and convenience in the drawings. The same reference signs are generally used to refer to corresponding or similar feature in modified and different embodiments.

DETAILED DESCRIPTION

FIG. 1 shows an exploded view of a prefabricated internal wall panel 10 according to an embodiment of the present invention. The panel broadly comprises a front gypsum based board 12, rear gypsum based board 14, head track 22 and base track 24 and side studs 26 and 28. The front board 12 forms an internal face of a room and can be finished accordingly. However, it is typically supplied as a plasterboard finish ready for decorating.

The front board is spaced away from the rear board. The rear board may either form a corresponding internal face for an adjacent room when the panel is used as an internal wall, or may form part of a party wall as will be described below. The rear wall is also typically plasterboard when the panel is used as an internal wall, or may be an alternative backboard surface such as cardboard or the like when the panel is used as a party wall, depending on the intended finish or use of the panel.

The front and back boards are connected to a head track 22 and a base track 24 and side studs 26 and 28 such that it provides a void or cavity therebetween. It can be appreciated that this cavity within the panel may be filled with an insulation product, such as Rockwool insulation slabs, or the like. The head track 22 and the base track 24, in embodiments, have the same profile, configured to engage with a floor support. This can allow the panel 10 to be inverted and installed in either orientation.

In the embodiment shown, the panel is an internal wall panel such that the front board and the rear board are gypsum based boards and form an internal face of a room. When used as a party wall, the rear board does not need to be gypsum based and can be cardboard as described above. In a party wall arrangement two panels may be arranged side by side, separated by a void that can be filled with insulation. Each panel is sealed to the floor and a soffit using intumescent fire sealant to provide resistance to fire to prevent fire from spreading from one dwelling or one side of the internal wall to the other dwelling or other side of the internal wall. This also acts to improve the acoustic properties of the panel.

Figure 2A:
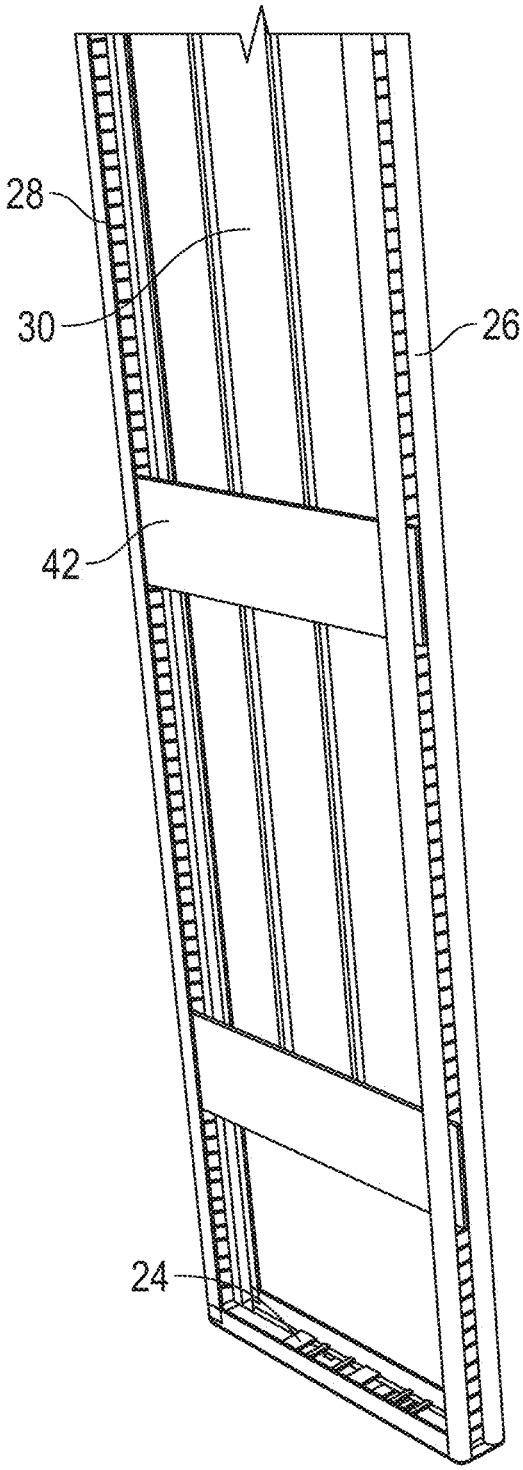
FIG. 2*a* shows the wall panel of FIG. 1 when connected but with the front and rear gypsum based boards removed.
Figure 2B:
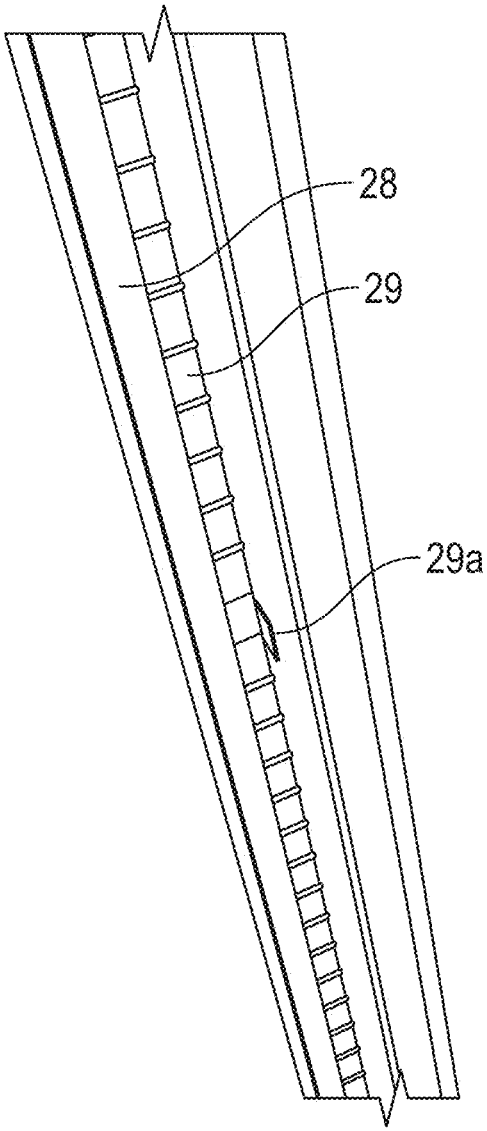
FIG. 2*b* shows a close-up view of side studs of FIG. 2*a*
Figure 2C:
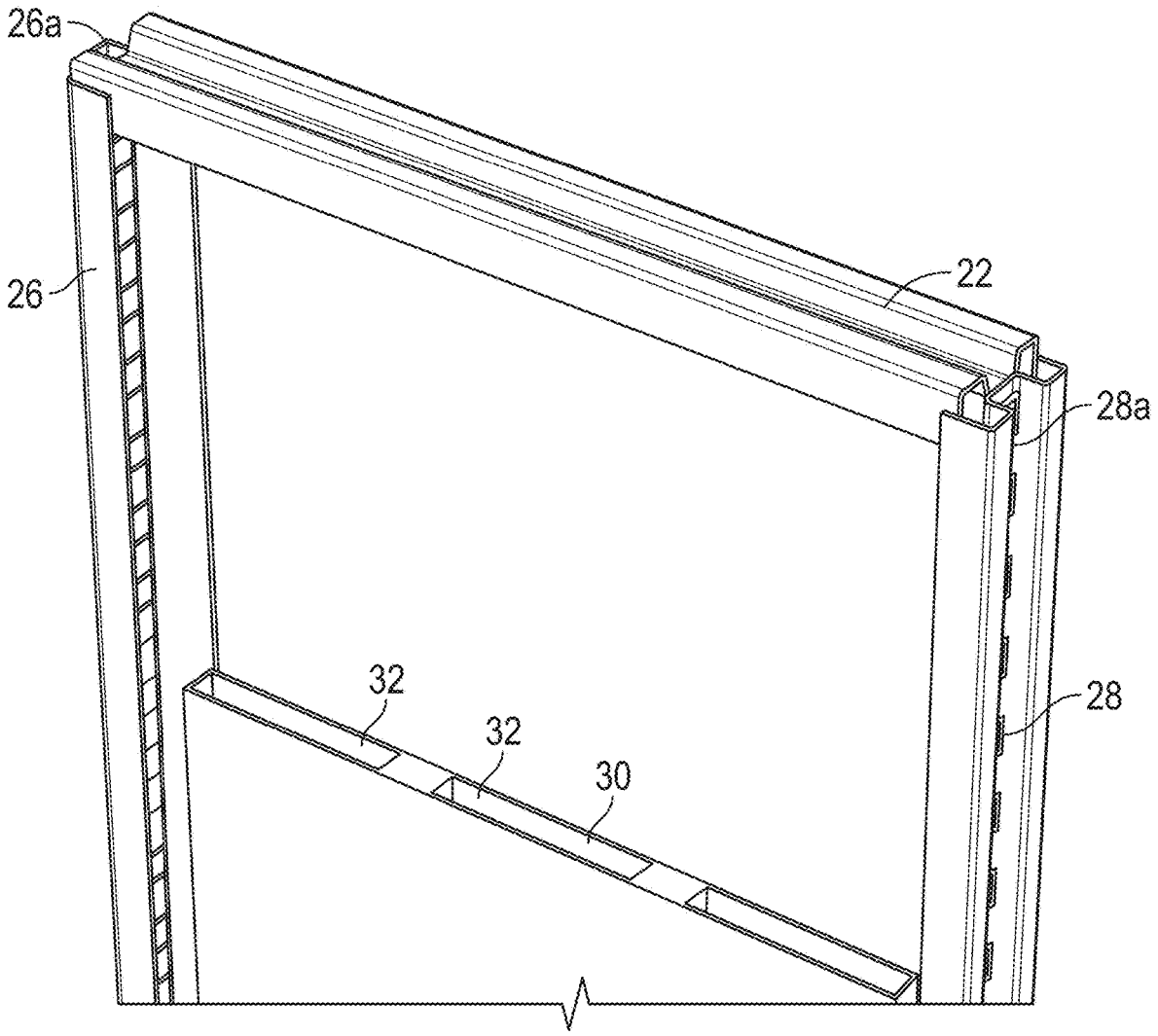
FIG. 2*c* shows a close-up view of the top of the wireway shown in FIG. 2*a;*

Side studs 26 and 28 are provided, said side studs are shown in greater detail in FIG. 2*c*. The side studs receive the head track 22 and the base track 24 to form a frame for the wall panel. The head track, base track and the side studs are typically metal, generally formed from sheet steel or aluminium. This forms a metal framework around the panel, which provides further fire resistance and again improves the acoustic properties of the panel. This metal framework provides a rigid frame into which the panels may be provided and secured, whilst allowing for the panels to be replaced if needed. Accordingly the framework provides the structural rigidity, rather than relying on the panels themselves.

In addition, a wireway 30 is provided within the cavity behind the front gypsum based board 12, although it can be appreciated that a similar wireway may be provided within the cavity behind the rear gypsum based board 14 when the panel is used as an internal wall. The wireway 30 runs along the height of the front board from a lower point adjacent to the base track to an upper point adjacent to the head track. The wireway typically comprises a number of channels or passages 32 through which cabling for services can be passed therethrough. In the example shown, 3 passages 32 are used, each running parallel to each other. The wireway is typically made of cardboard or the like to provide some degree of structural rigidity and resistance to piercing by the cables. In some embodiments the cardboard may be treated to be smooth with a lower coefficient of friction to aid passage of the cables through the channels.

Also shown in FIG. 1 are support rails 42 that are attached to the side studs and support the wireway 30. The support rails further act to support service backboxes and the like that are placed within the panel. Similarly pattress plates 44 may be provided in front of the wireway between the wireway and the front board to support fixtures and fittings such as TV wall frames or the like.

FIG. 2*a* is a schematic rear view and representation of an assembled wall panel, with the rear board removed. The wireway 30 is shown, supported on support rails 42 that are secured to the side studs 26, 28. The side studs 26, 28 are typically formed of folded metal, such as plate steel or aluminium or the like. As is further shown in FIG. 2*b*, the side struts has a series of pressed tabs 29 that face inwardly towards the cavity. The pressed tab 29*a* is shown in a folded out position to form a fixing point against which the support rails 42 can be fixed. In the example shown in FIG. 2*a*, each support rails 42 forms a brace against which the wireway 30 can be secured. By providing a series of tabs 29 along the length of the side studs 26, 28 the support rail 42 can be secured at any position along the height of the panel.

FIG. 2*c* shows a top portion of the wall panel 10. The side stud 26, 28 are secured by the head track 22 and form a part of the framework that braces a top part of the panel. The head track is typically of metal construction. As shown, the wireway 30 is secured in slots or grooves that run along the side struts. One side stud 26 has a male engagement portion 26*a*, which is configured to be received by a correspondingly shaped female engagement portion 28*a* in the opposite side stud 28. This allows the wall panel to be aligned against a corresponding adjacent wall panel to form a wall. The interlocking of the male and female engagement portions act to secure the wall against lateral movement.

Also shown in FIG. 2*c* are channels or passage 32 in the wireway. The wireway channels 32 run along the length of the wireway 30 and therefore along a substantial portion of the panel. Each channel 32 provides a separate passageway in which service cabling can run and be constrained. The wireway is typically formed of cardboard or the like, that is lightweight and substantially rigid enough to constrain fed cabling. The cardboard also acts to resist piercing through the channels to prevent the cabling being lost in the void. The cardboard may also be substantially smooth (such as with a coating) that acts to reduce friction between cabling and assist in passing cabling through the channels and from a top portion of the panel to a lower part of the panel.

Figure 2D:
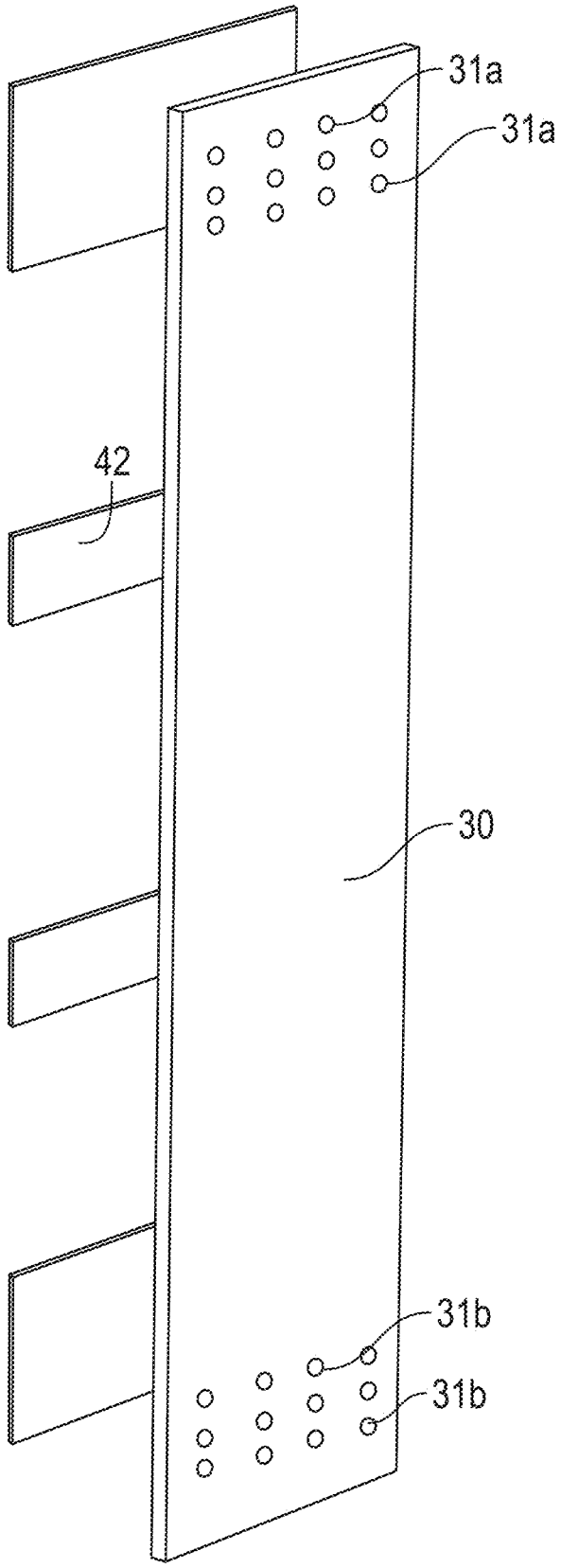
FIG. 2*d* shows the wireway of FIG. 2*c;*

FIG. 2*d* shows the wireway 30 in greater detail. The wireway has a length that is less than that of the full panel (as shown in FIG. 2*c*) but (between the three channels), the wireway runs within the majority of the cavity of the panel between the front and rear panels.

As shown in FIG. 2*d*, a number of perforations 31*a* are provided at the top of the wireway 30. The perforations 31*a* provide predefined entry points through which cabling can be fed from the front of the panel into the wireway 30 passages 32. Similarly, further perforations 31 bare provided at the bottom of the wireway 30 to allow for locating the wiring and/or for feeding cabling into or out of the front of the panel. Furthermore, as noted above, in embodiments the panel may be inverted—in this embodiment the use of perforations 31*a*, 31*b*, allow for the functionality described above (feeding wiring into the wireway 30 through the front of the panel from services running along the top of the panel) in either orientation.

Figure 3A:
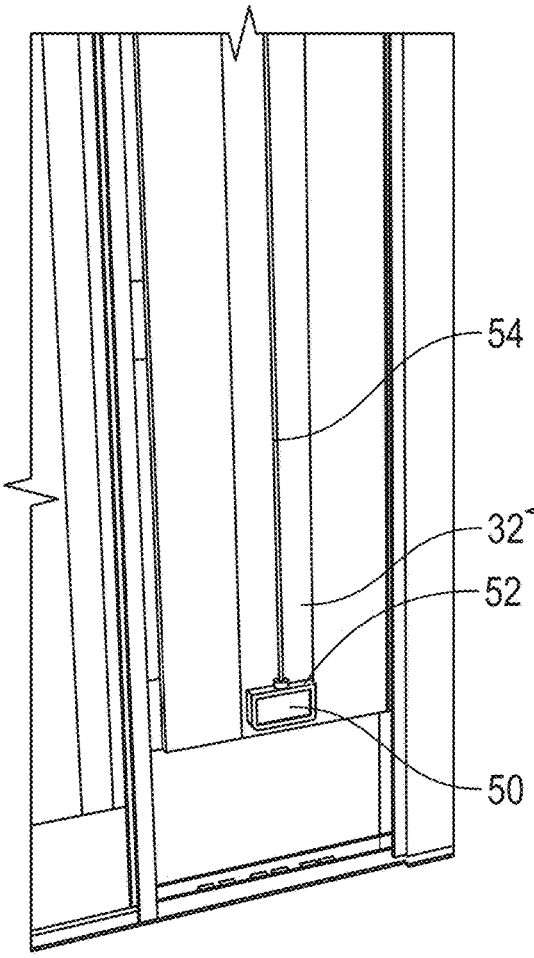
FIG. 3*a* shows a lower portion of the wall panel of FIG. 1 with the front board removed and with a backbox connected.

FIG. 3*a* shows the panel in use. A cutaway 50 has been made or chased out in the panel, through the plasterboard surface of the front board and through the cardboard of the wireway. As can be seen, the cutaway can be confined to a single channel, which the tradesperson knows lies within this broad location within the panel. A backbox 52 has been installed in the cutaway and a service cable 54 runs through the channel. The service block is secured to the support rail 42 to provide structural rigidity.

Figure 3B:
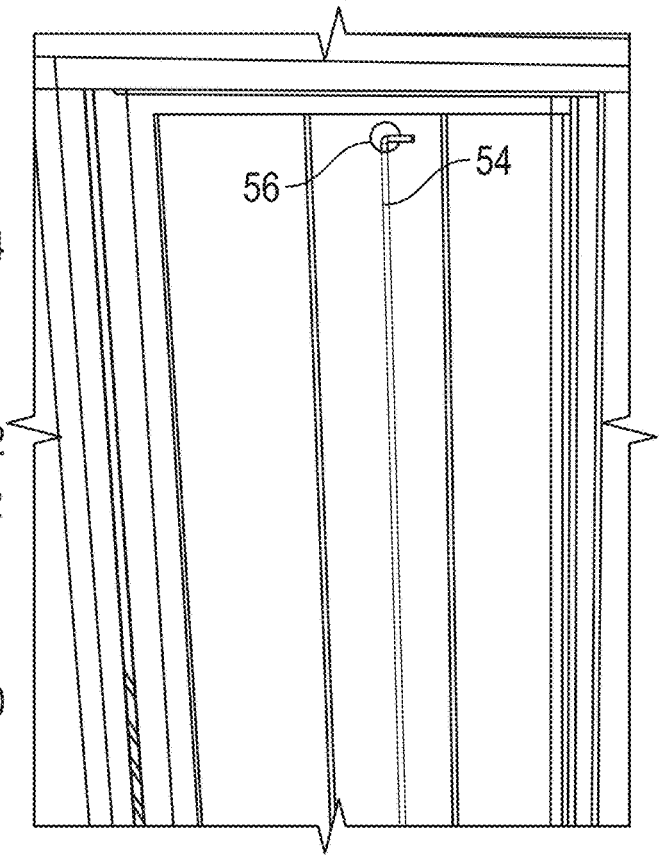
FIG. 3*b* shows an upper portion of the wall panel of FIG. 3*a*.
Figure 4:
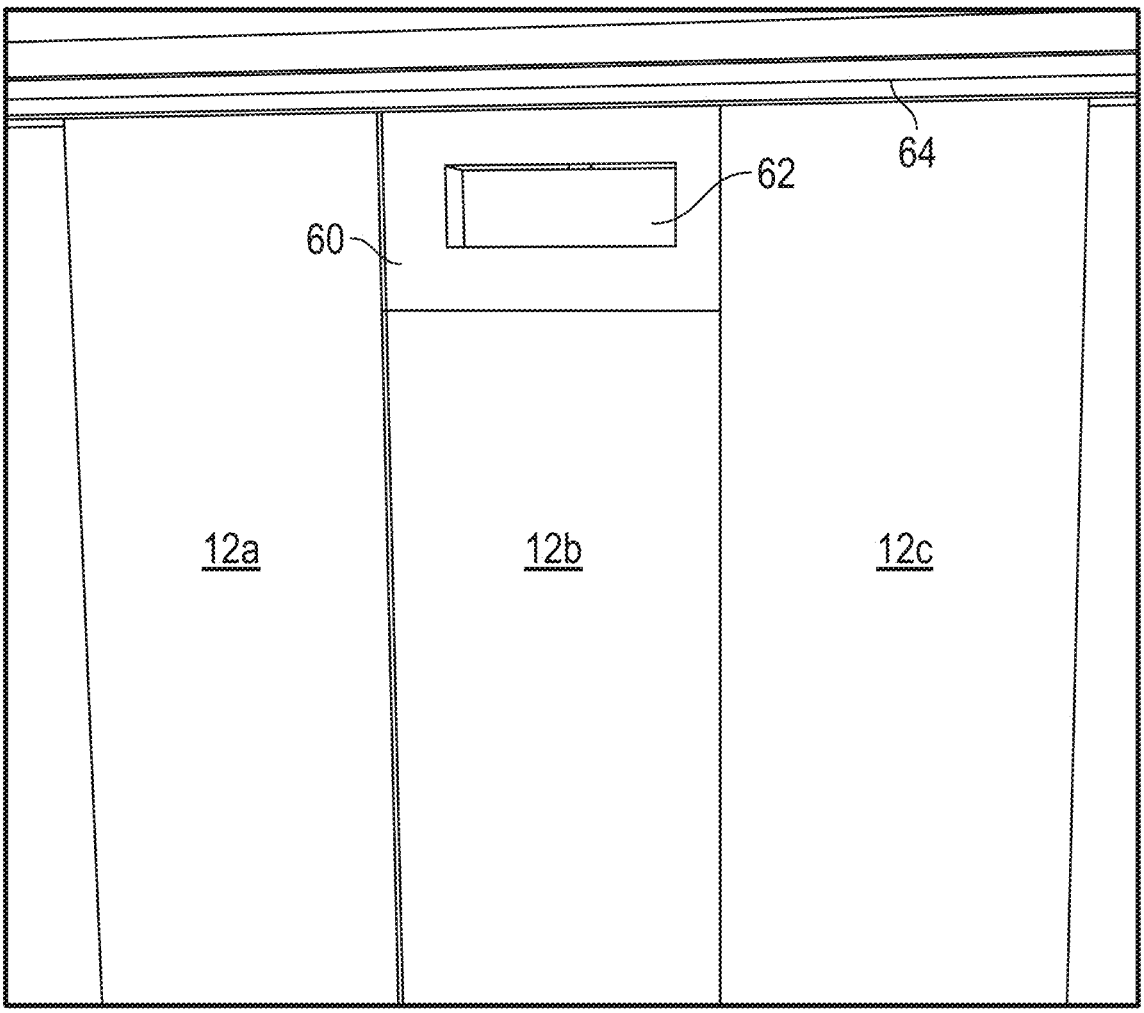
FIG. 4 shows a service opening panel according to an embodiment of the present invention.

The service cable 54 is fed through to the service block 52 through an opening 56 in the top portion of the panel as shown in FIG. 3*b*. The opening is either cut or chased through the panel and the wireway into the channel and provides an entry point at which the cabling can be fed to the backbox 52. FIG. 4 shows how services pass through walls. Typically panel 12*a* is installed, and where openings are required a shorter prefabricated panel 12*b* is formed and positioned, then a prefabricated opening panel 60 is installed. This panel 60 is formed to the correct size appropriate to services passing through with the gypsum based boards cut out 62. The next typical panel 12*c* can then be installed and the deflection head profile 64 is then installed at the head. Deflection profiles 64 are fixed to the soffit above which hold the panel in position whilst allowing for deflection in the building and maintaining acoustic and fire resistance performance.

Given the provision of a prefabricated wall panel having the wireway, internal walls can be assembled easily be an installation team, rather than being constructed on site. This reduces the time taken on-site and the number of people required on site. As an example, during installing services in the prefabricated wall panel, the wall may be formed by providing one or more wall panels such as shown in FIG. 4. One or more cutaways may then be made through said front board and said wireway. As noted above, advantageously the cutaway is located solely within one channel. A backbox may then be installed within said cutaway, secured to the support rail. Services cabling may then be fed through the one channel to the backbox through an opening in a top portion of the front board, which may be made by the services installer or services can pass through the wall via the prefabricated service installation panel.

The above described invention provides a prefabricated wall panel with a wireway that aids installation of services, in particular by constraining cabling in defined channels. In this way the cables are more easily fed through the wall panels from a supply in the ceiling to supply boxes at floor level without getting entangled or snagged within the panel. Furthermore, by having cabling within defined channels, the risk to service installers of later service cabling is reduced.

It can be appreciated that the various embodiments described above contain complimentary features that may be combined depending upon the need of the user. Accordingly, the method and systems described herein therefore provide a way of organising and sharing digital files.

Other embodiments are intentionally within the scope of the invention as defined by the appended claims.

The invention claimed is:

1. A prefabricated wall panel for forming internal walls in a building, said panel comprising:

a rear board;

a front board forming an internal wall for a room, said front board spaced away from said rear board to form a cavity;

a wireway disposed within the cavity, wherein the wireway comprises one or more channels that run substantially from a base of the wall panel to a top of the wall panel to allow services to pass through the panel, and wherein the wireway constrains cabling of the services within a channel; and a plurality of unitary pattress plates disposed between the wireway and the front board configured to support structural wall mounted fixtures and fittings, and wherein the pattress plates span substantially an entire width of the panel to allow for securing of said fixtures and fittings across the panel.

2. The panel of claim 1, wherein the wireway is made of cardboard.

3. The panel of claim 1, wherein the wireway runs substantially from the base of the wall panel to the top of the wall panel.

4. The panel of claim 1, wherein the front board further comprises a service access panel coupled to a top portion of the front board, said service access panel providing an opening through which the cabling of the services is configured to be passed through the wall.

5. The panel of claim 1, wherein the wireway is substantially same width and height as the cavity.

6. The panel of claim 1, wherein the panel is invertible.

7. The panel of claim 1, wherein the wireway comprises perforations or holes in a top of the wireway through which the cabling is configured to be fed.

8. The panel of claim 7, wherein the cabling is fed into a front of the panel through the perforations or holes.

9. The panel of claim 7, wherein the wireway further comprises an additional set of perforations or holes in a bottom of the wireway.

10. The panel of claim 1, wherein the panel further comprises:

two side studs, each side stud connected to the front and rear board on opposing sides of the cavity; and one or more support rails connected across said side studs and between the rear board and the wireway for supporting the wireway.

11. The panel of claim 10, wherein the panel further comprises a backbox secured to one of the support rails in a cutaway through the front board and the wireway.

12. The panel of claim 10, wherein the side studs comprise a plurality of tabs, said tabs extendable away from the side studs into void and providing a fixing point for the support rails.

13. The panel of claim 12, wherein the side studs comprise a metal profile, and wherein the tabs are punched into the profile.

14. The panel of claim 13, wherein the tabs are configured to fold away from the profile to provide the fixing point.

15. A method for installing services in a prefabricated wall panel, said method comprising the steps of:

forming a wall comprising one or more wall panels according to claim 1;

creating a cutaway through said front board and said wireway, said cutaway located solely within one said channel;

installing a backbox within said cutaway;

feeding the services cabling through the one channel to the backbox through an opening in a top portion of the front board.

* * * * *